US005397163A

United States Patent [19]

Puerner

[11] Patent Number: 5,397,163

[45] Date of Patent: Mar. 14, 1995

[54] SUSPENSION ARRANGEMENT FOR AN ARTICLE OF FURNITURE

[76] Inventor: Christoph Puerner, Adam-Krafft-Strasse 6, D-8590 Marktredwitz, Germany

[21] Appl. No.: 988,233

[22] Filed: Dec. 9, 1992

[30] Foreign Application Priority Data

Dec. 12, 1991 [DE] Germany ..... 9115439 U

[51] Int. Cl.[6] ..... A63G 9/00

[52] U.S. Cl. ..... 297/273; 248/370

[58] Field of Search ..... 297/273, 277, 278, 279, 297/283; 248/317, 370

[56] References Cited

U.S. PATENT DOCUMENTS

| | | | |
|---|---|---|---|
| 216,753 | 6/1879 | Ordway | 248/370 |
| 283,988 | 8/1883 | Evesson | 248/370 X |
| 830,702 | 9/1906 | Forey | 297/273 X |
| 1,941,901 | 1/1934 | Knabusch et al. | 248/370 |
| 2,283,000 | 5/1942 | Feldman | 297/273 X |
| 2,567,612 | 9/1951 | McGehee | 248/370 X |
| 2,667,207 | 1/1954 | Magyar | 248/370 X |
| 4,790,598 | 12/1988 | Locker | 297/273 X |
| 4,793,607 | 12/1988 | Suellentrop | 297/273 X |
| 5,088,730 | 2/1992 | Appleton | 297/277 X |
| 5,107,556 | 4/1992 | Haider | 248/370 X |

*Primary Examiner*—Rodney M. Lindsey
*Attorney, Agent, or Firm*—Gifford, Groh, Sprinkle, Patmore and Anderson

[57] ABSTRACT

A suspension arrangement for example for an article of furniture such as a chair comprising a base portion and a support surface portion movable relative thereto has cable hang members by which the support surface portion is suspended on the base portion. Two or more cable hang members are arranged functionally in series at each suspension location and the series-connected hang members are at least approximately of the same hang length. The mounting locations of the hang member ends which are opposite to the support surface portion and of the hang member ends which are opposite to the base portion are connected together by a frame structure.

21 Claims, 4 Drawing Sheets

SUSPENSION ARRANGEMENT FOR AN ARTICLE OF FURNITURE

BACKGROUND OF THE INVENTION

The invention concerns a suspension arrangement for example for an item of furniture for sitting or resting thereon.

In this specification the expression article of furniture will be used broadly to denote an article for sitting or resting or lying thereon.

Such an article of furniture typically comprises a base portion such as a leg assembly, and a support surface portion for supporting a person sitting or lying on the article of furniture, with the support surface portion being movable relative to the base portion.

On form of suspension arrangement for an article of furniture of that kind provides that the upper support surface portion is suspended in relation to the lower base portion by cable hang members. Two or more cable hang members the arranged functionally in series at each suspension location, and the mounting locations of the ends of the respective hang members, which are remote from the support surface portion, and of the ends of the respective hang members which the remote from the base portion, are connected together. A suspension arrangement of that configuration is to be found in WO-A-86/04793. In that arrangement the cable hand members which are functionally connected in series are of different hang lengths and thus each have different fundamental or natural frequencies. That design principle is intended to ensure that, when the oscillatable system is excited with pulses of varying frequency, at least one of the cable hang members is always excited at or almost at its natural frequency in order to produce sufficient oscillation amplitudes even then weal pulses are involved.

SUMMARY OF THE INVENTION

An object of the present invention is to provide a suspension arrangement which, while being of a compact structure, permits a very high degree of dynamic performance and thus ensures a very high level of sensitisation in relation to fine vibrations with at the same time good stabilisation and damping qualities in relation to large deflection movements.

Another object of the present invention is to provide a suspension arrangement which, while being of a simple design configuration, is versatile in use.

Still another object of the present invention is to provide an article of furniture such as a chair or couch which enjoys an enhanced level of comfort for the occupant.

In accordance with the principles of the present invention the foregoing and other objects are achieved by a suspension arrangement, for example for an article of furniture which comprises a base portion and a support surface portion which are movable relative to each other, the suspension arrangement comprising cable hang members by which the upper support surface portion is suspended from the lower base portion. At least two cable hang members are arranged functionally in series at each suspension location and the mounting locations of the hang member ends which are remote from the support surface portion and of the hang member ends which are remote from the base portion are connected together. The hang members which are disposed in series are at least of approximately the same hang length.

In a preferred feature of the invention the connection between the mounting locations of the hang member ends which are remote from the support surface portion and of the hang member ends which are remote from the base portion comprises a frame whose height corresponds to the hang member length, wherein the respective cable hang member which is fixed to the support surface portion is fixed to the top side of the frame while the respective cable hang member which is fixed to the base portion is fixed to the underside of the frame.

In a preferred embodiment of the invention the frame comprises first and second flat bar portions which are arranged at least substantially perpendicularly one above the other and which are provided with resilient buffers such as rubber buffers. The support surface portion is connected to a hang member which is passed through an aperture in the lower bar portion and which is fixed by its other end to the upper bar portion. The hang member which is fixed to the base portion is passed through an aperture in the upper flat bar portion and secured by its other end to the lower flat bar portion.

In another advantageous configuration according to the invention, there is provided a plurality of mutually concentric frames which are connected together by the series-disposed cable hang members. The frames are advantageously arranged in superposed aligned relationship. The frames desirably have apertures through which the hang members are passed to the opposite side of the frame structures.

In accordance with a preferred feature of that arrangement, the frames are connected together by spring elements, for example and preferably yielding or flexible rubber buffers. Depending on the area of use, the frames may be of a triangular, quadrangular or polygonal configuration, with the hang member connections preferably being disposed in the regions of the respective corners. The frames may advantageously be of a box-like configuration with closed side walls.

In a preferred embodiment of the arrangement according to the invention, there is provided a plurality of frames of the same configuration but different cross-sections. In relation to adjacent frames, the larger frame has limb portions to which one end of a respective hang member is secured, the other end of that hang member being secured to the next smaller frame. Preferably, the hang member which is fixed to the support surface portion operatively engages the largest frame while the hang member which is fixed to the base portion is operatively connected to the smallest frame.

In another preferred embodiment, abutment elements, preferably supported balls, are operatively disposed between the members which are movable relative to each other in order to limit the deflection movement thereof.

In an advantageous embodiment of the invention the frame portions with the hang members connecting them are disposed in a housing which is fixed to the base portion or to the support surface portion. Preferably the base portion passes at least substantially centrally through the housing. When the housing is connected to the support surface portion, provided between the base portion and the housing is a spacing to permit oscillatory movement between the base portion on the one hand and the support surface portion with housing on the other hand.

In a preferred embodiment of the article of furniture, a backrest portion is fixed to the frame or corresponding connecting structure. The backrest portion is advantageously connected by way of a spring means to a lower support element of the frame or other connecting structure.

Further objects, features and advantages of the present invention will be apparent from the following description of preferred embodiments.

DESCRIPTION OF PREFERRED EMBODIMENTS

Figure 1:
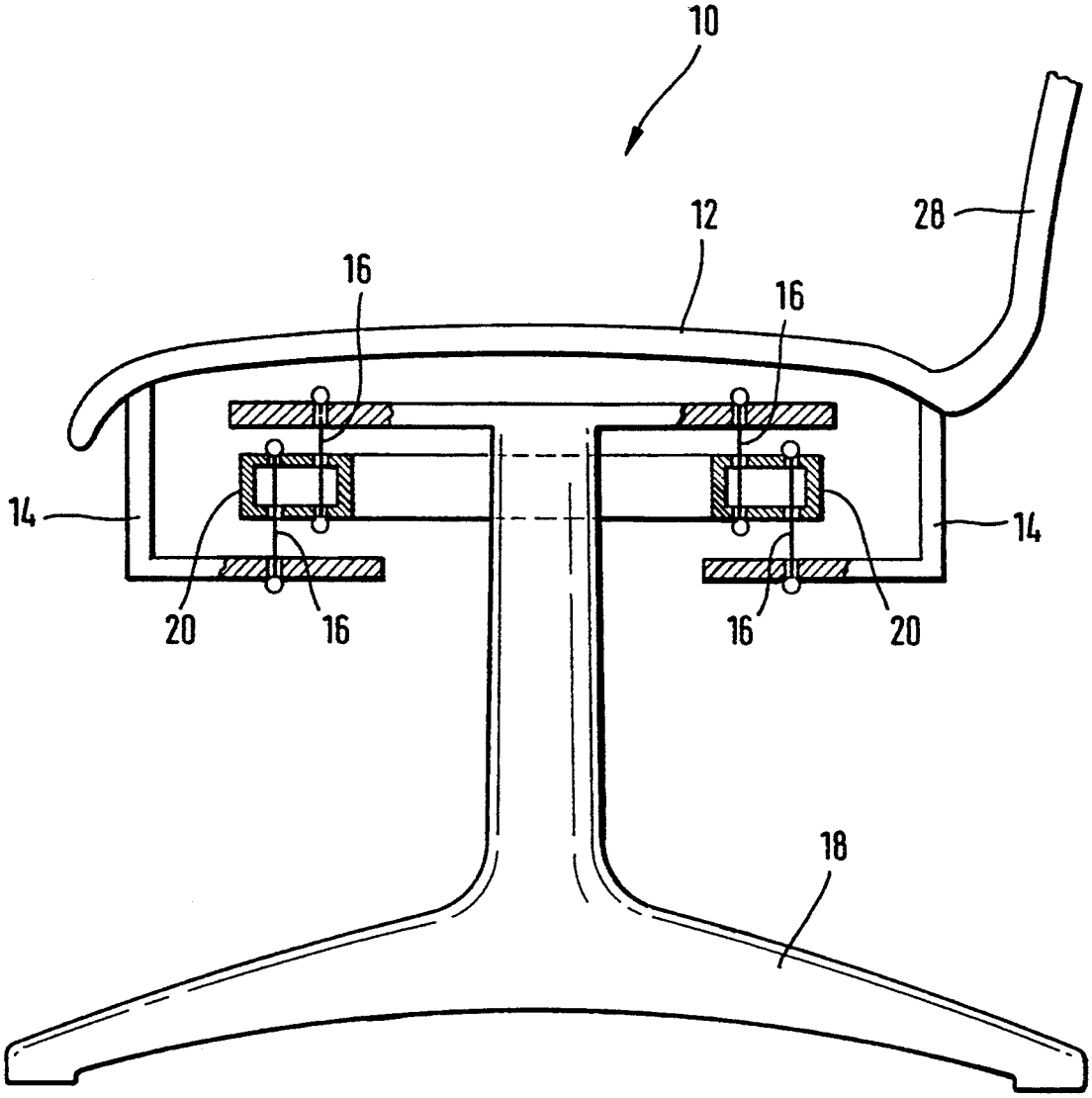
FIG. 1 is a diagrammatic view of a first embodiment of a suspension arrangement according to the invention, in an article of furniture in the form of a seat or chair.

Referring firstly to FIG. 1, shown therein is a suspension arrangement according to the invention which is used in the context of an article of furniture in the form of a seat or chair as generally identified by reference numeral 10. The article 10 comprises an upper support surface portion 12 which includes a support assembly 14 which extends downwardly therefrom. The support surface portion 12 is suspended by means of the support assembly 14 and by way of cable hang members 16 on a lower base portion 18 in such a way as to be capable of swinging movement in relation thereto. The support assembly 14 may be of a frame-like or box-like configuration or it may comprise a plurality of support arms. At each suspension location, that is to say where a connection is provided between the upper support surface portion 12 and the base portion 18, two cable hang members 16 which are at least approximately of the same hang length are functionally connected in series. The mounting locations of the hang member ends which are remote from the support surface portion 12 and of the hang member ends which are remote from the base portion 18 are rigidly connected together by way of a frame as diagrammatically indicated at 20, the height of which corresponds to the hang length. The cable hang member 16 which is operatively secured to the support surface portion 12, by way of the support assembly 14, is swingingly attached to the top side of the frame 20, at its end which is remote from its point of attachment to the support assembly 14, while the cable hang member 16 which is fixed at one end to the base portion 18 is fixed at its other end to the underside of the frame 20. The respective cable hang members 16 are passed through apertures in the frame 20 to the respective oppositely disposed side of the frame 20. The suspension arrangement 10 shown in FIG. 1 is a side view. However, if viewed from the front, the pairs of hang members 16 would be preferably located at respective corners of the polygonal frames. Although this feature cannot be seen in the drawings as presented, it is desirable to place the hang members at the corners of the frames so as to provide lateral support for the suspension arrangement.

To provide protection for the components, the frame portions with the cable hang members 16 interconnecting the various parts can be disposed in a housing which is fixed to the base portion 18 or to the support surface portion 12. The base portion 18 passes centrally through the housing, a spacing being provided between the base portion 18 and the housing to permit oscillatory movement between the support surface portion 12 with housing fixed thereto on the one hand and the base portion 18 on the other hand.

The suspension arrangement illustrated in FIG. 1, in comparison with a suspension arrangement of the above-discussed prior kind, is distinguished by affording a substantially improved oscillation characteristic, while being of a compact and simple structure. It permits a very high degree of dynamic effect, even when very fine vibrations are involved, with at the same time good stabilisation and damping qualities in relation to major deflections.

Figure 2:
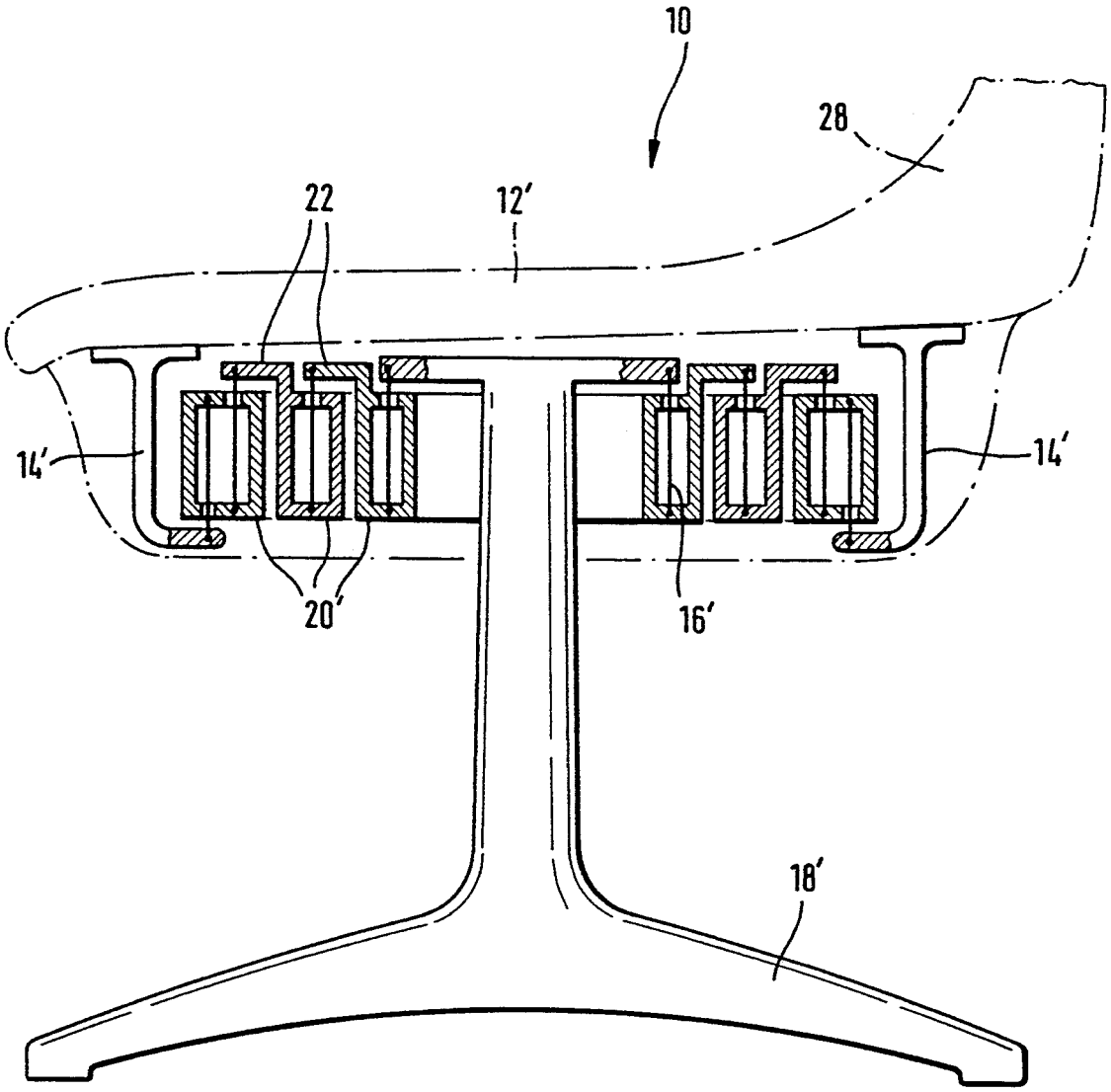
FIG. 2 is a corresponding view of a second embodiment of a suspension arrangement according to the invention having a plurality of concentrically disposed frames.

Reference will now be made to FIG. 2 showing a suspension arrangement according to the invention which makes it possible to achieve an additional improvement in the oscillation characteristic of the arrangement. In the FIG. 2 structure, which is diagrammatically illustrated by way of example in relation to an article of furniture 10 in the form of a seat, the suspension arrangement comprises a plurality of mutually concentric frames 20' which are operatively connected together by cable hang members 16' which are functionally connected in series.

The connection between a support assembly 14' on a support surface portion 12' and a base portion 18' of the seat 10 is made by way of three frames 20' of the same configuration but of different cross-sections, which are arranged concentrically one within another. In relation to adjacent frames 20', in each case the smaller frame 20' has limb portions as indicated at 22, to which one end of a respective cable hang member 16' is fixed. The limb portions 22 are extended over the respective next larger frame 20' in such a way that the respective cable hang member 16' is fixed by its other end to the underside of the next larger frame 20'. In this arrangement the cable hang member 16 which is fixed to the support surface portion 12' engages the top side of the largest frame 20' which, as can be seen from FIG. 2, is not provided with a corresponding limb portion 22. The cable hang member 16 which is fixed to the base portion 18' is connected to the smallest frame 20'. The cable hang members 16' are passed by way of respective apertures in the respective frames 20' to the respective suspension points.

Figure 3:
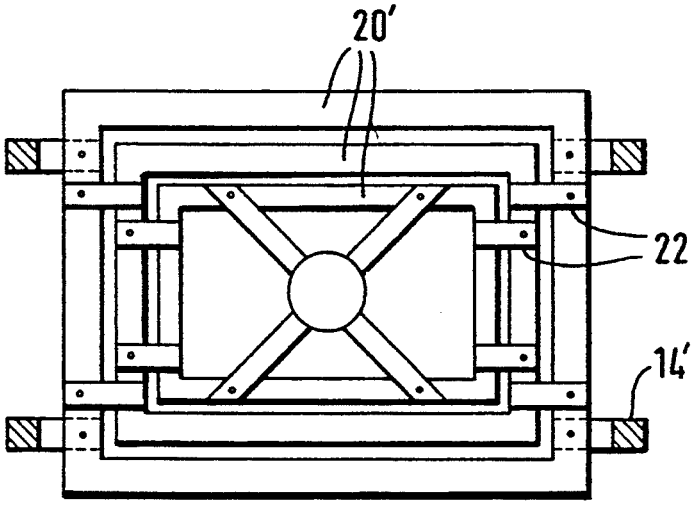
FIG. 3 is a plan view of the frame arrangement shown in FIG. 2.

A plan view of the frame configuration shown in FIG. 2 is illustrated in FIG. 3 which clearly identifies the spatial relationships between the frames 20' and the limb portions 22.

Figure 4:
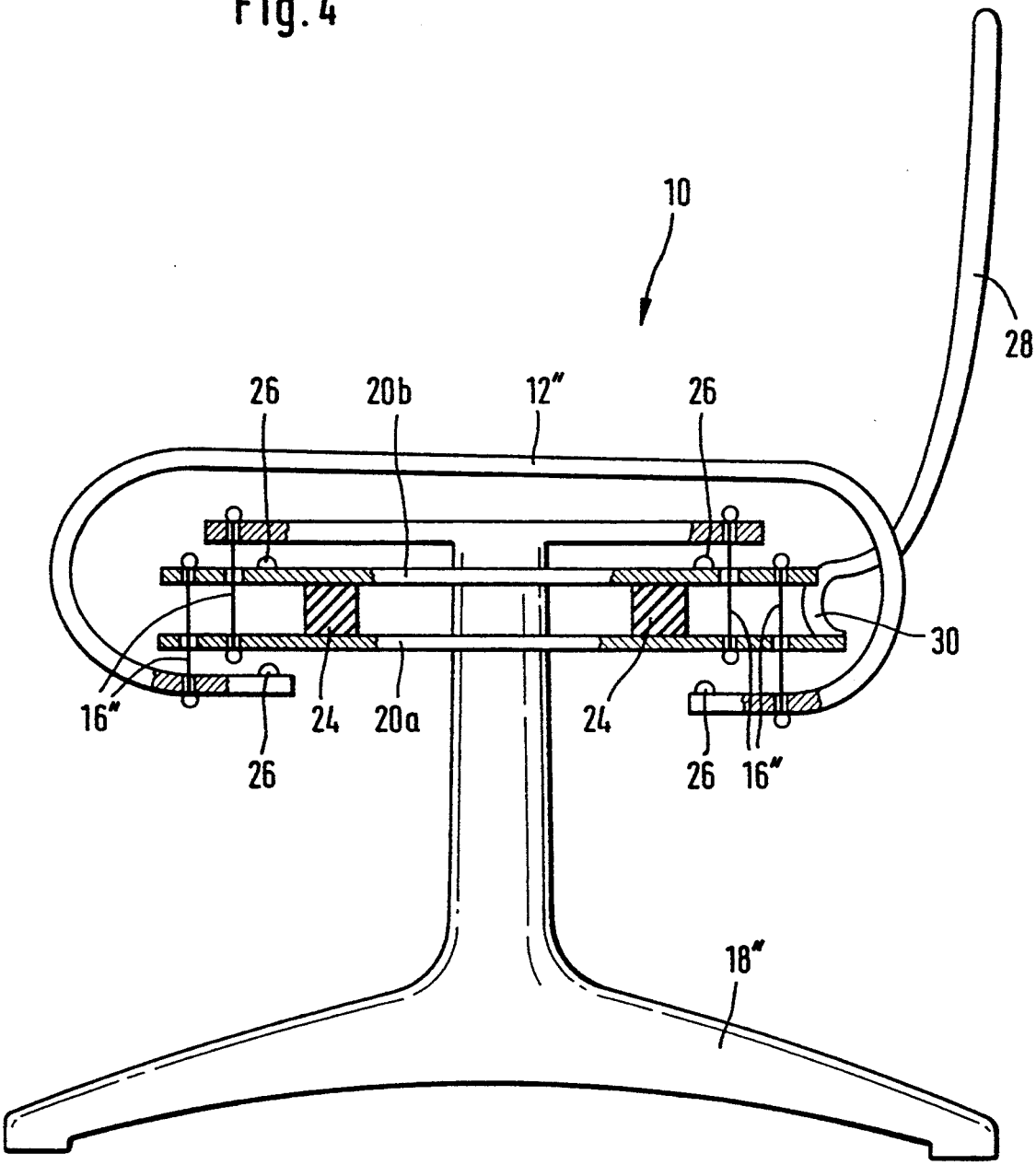
FIG. 4 is a view of a third embodiment of a suspension arrangement according to the invention with a backrest.

Referring now to FIG. 4, shown therein is an embodiment of the suspension arrangement according to the invention, used once again by way of example in relation to an article of furniture in the form of a seat 10. The arrangement again comprises a frame which has first and second flat bar portions **20*a* and 20*b* which are arranged at least substantially vertically one above the other and which are connected together by resilient buffers 24, for example of rubber. A cable hang member 16'' which is fixed to a support surface portion 12''** is passed through an aperture in the lower flat bar portion 20*a* and is swingingly attached by means of its upper end to the upper flat bar portion 20*b*. The cable hang member 16″ which is fixed to a base portion 18″ is passed through an aperture in the upper flat bar portion 20*b* and fixed by its other end to the lower flat bar portion 20*a*. Disposed between the members which are movable relative to each other are abutment elements as indicated at 26, for limiting the relative movement thereof. The abutment elements 26 which are disposed between the upper flat bar portion 20*b* and a base portion 18″, and between the lower flat bar portion 20*a* and the support surface portion 12″, comprise mounted balls which contact the surface of the base portion and the support surface portion which oppose the upper and lower flat bar portions upon a given amount of pivoting and also accommodate a lateral movement of the components with respect to the base portion and the support surface portion.

It will be noted in relation to the article of furniture 10 shown in FIG. 4 that, unlike the embodiments described above with reference to FIGS. 1 through 3 in which the backrest 28 of the article of furniture 10 was integrally connected to the support surface portion 12, the backrest 28 in the FIG. 4 embodiment is connected by way of a spring element 30 to the lower flat bar portion 20*a* which thus constitutes a carrier element for the backrest 28. In comparison with conventional seats or chairs, that permits the backrest 28 to oscillate or swing in such a fashion as to be substantially decoupled from the oscillatory movement of the support surface portion 12, thereby providing for an additional improvement in the oscillation characteristic of the seat or chair.

Figure 5:
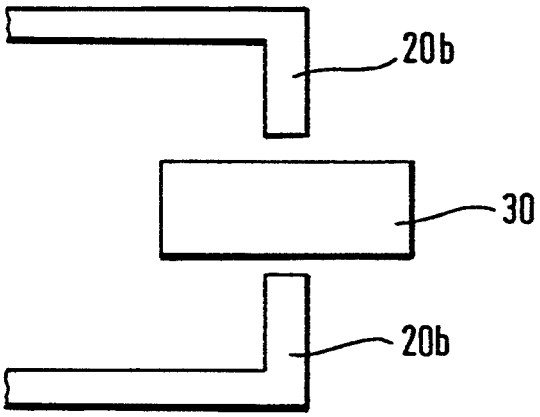
FIG. 5 is a top view in section of the upper flat bar portions provided laterally on opposite sides of the spring element.

FIG. 5 is a top view in section showing the upper flat bar portions 20*b* of FIG. 4 which extend laterally and oppositely from the spring element 30. The spring element portion 30 of the backrest 28 extends between the upper flat bar portions but does not touch the flat bar portions.

It will be noted here that the structure and mode of operation of the suspension arrangement according to the invent ion has been described by way of example hereinbefore with reference to the accompanying drawings, in relation to an article of furniture in the form of a seat or chair. It will be appreciated that the suspension arrangement can also be used in relation to other articles of furniture for occupancy by a person such as a couch or the like, and the arrangement according to the invention can also be advantageously used for example in the mounting of highly sensitive machines or items of equipment.

It will be appreciated that the above-described embodiments have been set forth solely by way of example and illustration of the principles of the present invention and that various other modifications and alterations may be made therein without thereby departing from the spirit and scope of the invention.

What is claimed is:

1. A suspension arrangement for an article of furniture which includes a base portion and a support surface portion movable relative to said base portion, said suspension arrangement comprising:

a plurality of cable hang members at a plurality of suspension locations between the support surface portion and the base portion, said cable hang members each having opposing ends for suspending the support surface portion from the base portion, at least two of said plurality of cable hang members being arranged in series at each said suspension location, said cable hang members which are arranged in series being at least approximately of a same hang member length, and means for connecting together a mounting location for said hang member ends which are arranged in series, said means connecting a first of said cable hang members extending from the base portion with a second of said cable hang members extending from the support surface portion, said first cable hang member being remote from said support surface portion and said second cable hang member being remote from said base portion.

2. The suspension arrangement as set forth in claim 1 wherein said connecting means comprises a frame having a height corresponding to the hang member length and which has a top side and an underside, and wherein a said cable hang member which is fixed to said support surface portion is fixed to said top side of the frame and a said cable hang member which is fixed to said base portion is fixed to said underside of the frame.

3. The suspension arrangement as set forth in claim 1 wherein said connecting means comprises a plurality of concentric frames which are connected together by said cable hang members arranged in series.

4. The suspension arrangement as set forth in claim 3 wherein said plurality of concentric frames are arranged in aligned superposed relationship.

5. The suspension arrangement as set forth in claim 3 wherein said plurality of concentric frames have apertures formed therethrough, said respective cable hang members are passed through said apertures to respective opposite sides of the respective frames.

6. The suspension arrangement as set forth in claim 3 further comprising means for providing resiliency between said frames, said resiliency means connecting said frames together.

7. The suspension arrangement as set forth in claim 6 wherein said resiliency means are yielding rubber buffers.

8. The suspension arrangement as set forth in claim 2 wherein said frame is of a polygonal configuration and wherein said hang members are provided in the regions of corners of said frame.

9. The suspension arrangement as set forth in claim 3 wherein said plurality of concentric frames are polygonal and wherein hang members are provided in the regions of corners of said frame.

10. The suspension arrangement as set forth in claim 2 wherein said frame is of a box-like configuration with closed side walls.

11. The suspension arrangement as set forth in claim 3 wherein said plurality of concentric frames are of a box-like configuration with closed side walls.

12. The suspension arrangement as set forth in claim 11 comprising a plurality of frames of the same configuration but having different cross-sections, wherein, in relation to adjacent frames, a smaller frame has limb portions to which one end of said cable hang members are fixed, said respective cable hang members being fixed at their other ends to a next larger frame.

13. The suspension arrangement as set forth in claim 12 wherein the cable hang members fixed to the support surface portion operatively engage a largest of said frames and the cable hang members fixed to a base portion are operatively connected to a smallest of said frames.

14. The suspension arrangement as set forth in claim 7 wherein said frame comprises first and second flat bar portions which are disposed at least substantially parallel one above the other and which have apertures extending therethrough, said flat bar portions are connected together by said rubber buffers, and wherein said support surface portion is connected to one end of a said cable hang member which is passed through an aperture in the lower flat bar portion and which is fixed by its other end to the upper flat bar portion, and a said cable hang member which is fixed to the base portion is passed through an aperture in the upper flat bar portion and fixed by its other end to the lower flat bar portion.

15. The suspension arrangement as set forth in claim 1 and further including a housing fixed to said support surface portion and wherein said connecting means include at least one frame member which with said cable hang members are disposed in said housing.

16. The suspension arrangement as set forth in claim 15 wherein said base portion passes substantially centrally through said housing, a spacing being provided between said base portion and said housing to permit oscillatory movement between said support surface portion with said housing and said base portion.

17. The suspension arrangement as set forth in claim 1 and further including abutment elements disposed between the cable hang members which are movable relative to each other.

18. The suspension arrangement as set forth in claim 17 wherein said abutment elements comprise mounted balls.

19. The suspension arrangement as set forth in claim 1 and further including a backrest portion carried upon said connecting means.

20. The suspension arrangement as set forth in claim 19 wherein said connecting means comprise a frame which includes a lower carrier element, and further including a spring element which connects said backrest portion to said lower carrier element.

21. A suspension arrangement for suspendingly interconnecting first and second members which are disposed one above the other and which are movable relative to each other, the suspension arrangement comprising: a plurality of cable hang members extending at a plurality of suspension locations between the first and second members, said cable hang members each having opposing ends for interconnection the first and second members in a movable suspended relationship, at least a first and a second cable hang member of said cable hang members being arranged in series at each of said suspension locations, said cable hang members which are disposed in series being at least approximately of a same hang member length; and frame means interconnecting a plurality of mounting locations of said ends of said cable hang members, said frame means connecting a first of said cable hang members extending from the fist member with a second of said cable hang members extending from the second member, said first cable hang member being remote from the second member and said second cable hang member being remote from the first member.

* * * * *